US006807683B2

(12) United States Patent
Williams

(10) Patent No.: US 6,807,683 B2
(45) Date of Patent: Oct. 26, 2004

(54) WATERPROOF, BREATHABLE ARTICLES OF APPAREL

(76) Inventor: Cole Williams, 1020 Hamilton Rd., Unit G, Duarte, CA (US) 91010

( * ) Notice: Subject to any disclaimer, the term of this patent is extended or adjusted under 35 U.S.C. 154(b) by 0 days.

(21) Appl. No.: 09/978,441

(22) Filed: Oct. 15, 2001

(65) Prior Publication Data

US 2002/0017358 A1 Feb. 14, 2002

Related U.S. Application Data

(63) Continuation-in-part of application No. 09/384,938, filed on Aug. 27, 1999, now abandoned.

(51) Int. Cl.[7] ..... B32B 31/00; A41B 11/00

(52) U.S. Cl. ..... 2/239; 2/159; 156/212; 156/308.2

(58) Field of Search ..... 2/239, 159; 156/212, 156/308.2, 309.6, 123, 239

(56) References Cited

U.S. PATENT DOCUMENTS 4,679,257 A * 7/1987 Town ..... 2/164
4,829,602 A * 5/1989 Harreld et al. ..... 2/51
4,942,214 A * 7/1990 Sakhpara ..... 528/59
5,588,155 A * 12/1996 Baker et al. ..... 2/123
5,655,226 A * 8/1997 Williams ..... 2/239
5,680,653 A * 10/1997 Mathis et al. ..... 2/123

FOREIGN PATENT DOCUMENTS

WO WO-92/07480 A1 * 5/1992
WO WO-98/19569 A1 * 5/1998

* cited by examiner

*Primary Examiner*—Jeff H. Aftergut
(74) *Attorney, Agent, or Firm*—James E. Brunton, Esq.

(57) ABSTRACT

Articles of apparel and the method of making the same which include a sealable cuff portion and a shaped body portion that will allow water vapor due to perspiration to transpire through the article but will prevent water from external sources from reaching the wearer's extremities. The articles of apparel include a body portion that is of three-ply construction with the inside and outside plies being knit and the intermediate ply being made from an elastomeric polyurethane film. The three plies uniquely bonded together using a pliant, waterproof adhesive. The sealable cuff portion is of a two-ply construction with the outside ply being an elastic knit and the inside ply being a continuation of the elastomeric polyurethane film of the body portion. The adhesive on the continuation of the film is melted to form a smooth surface that sealably engages the user's extremity to prevent entry of water between the user's skin and the film.

11 Claims, 4 Drawing Sheets

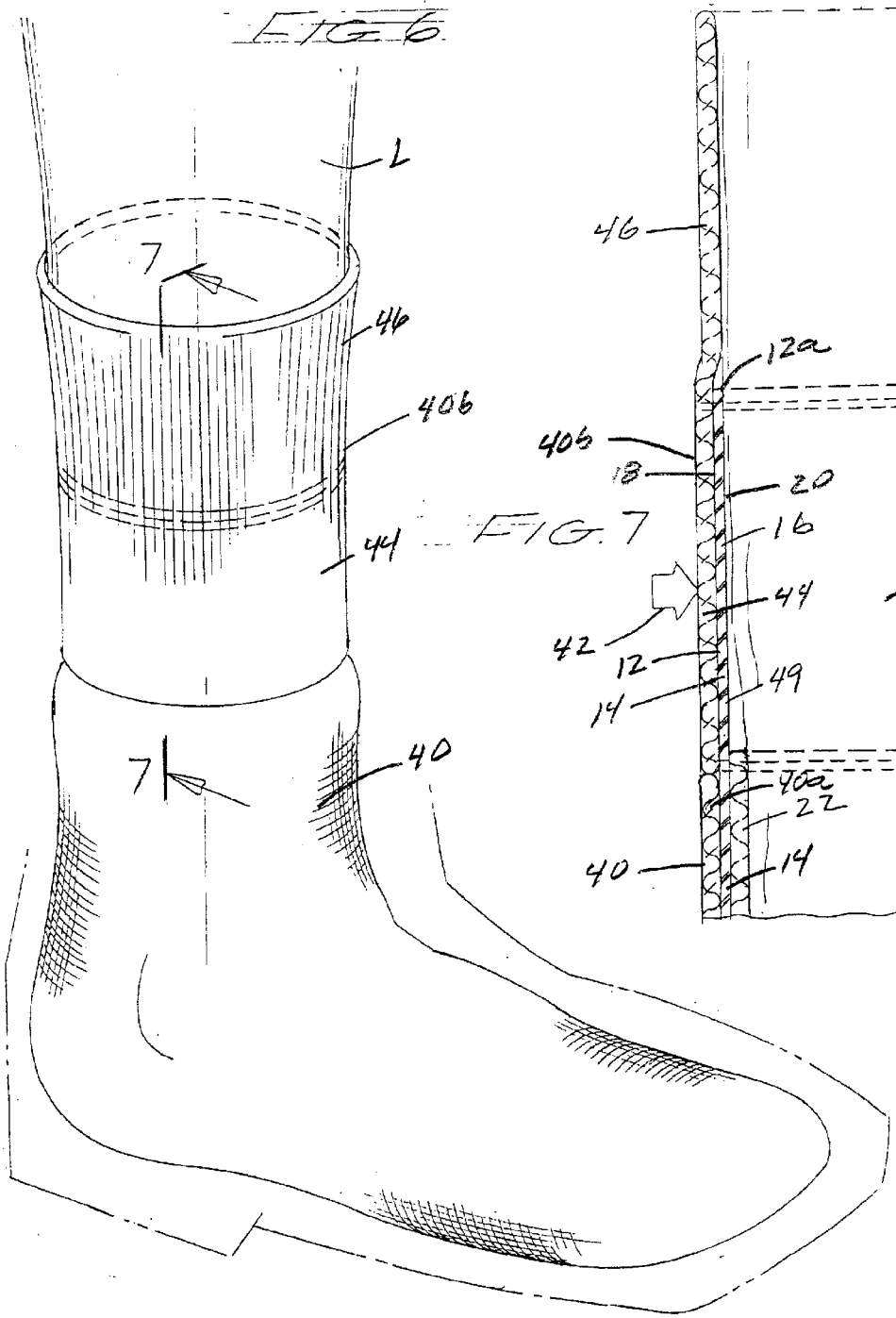
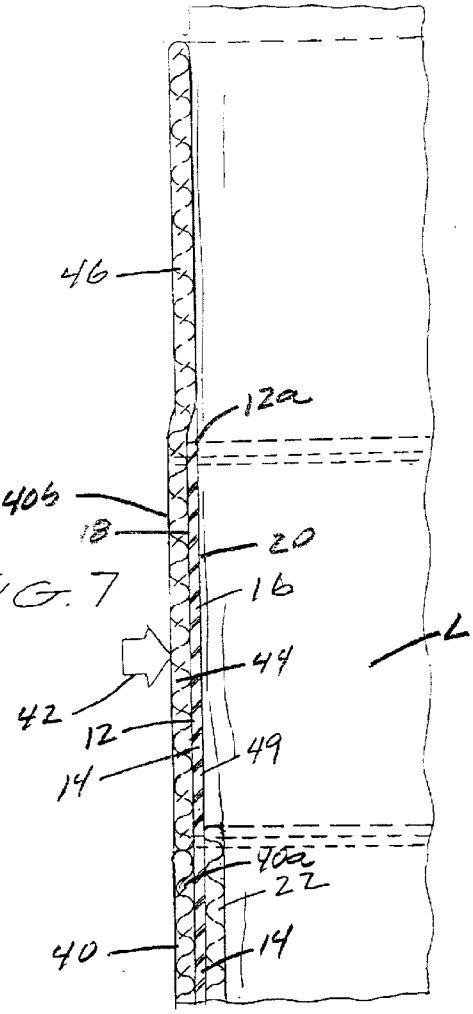
FIG. 7

9
46
44
40
9
12

47
46
44
16
49
47
12
22
40
14

WATERPROOF, BREATHABLE ARTICLES OF APPAREL

This is a Continuation-In-Part application of application Ser. No. 09/384,938 filed Aug. 27, 1999, now abandoned.

BACKGROUND OF THE INVENTION

1. Field of the Invention

The present invention relates generally to articles of apparel. More particularly, the invention concerns improved articles of apparel used to cover the wearer's extremities such as an improved, waterproof sock that includes a novel sealing cuff and a body portion that will permit perspiration to transpire through the sock, but will keep water from external sources away from the wearer's foot.

2. Discussion of the Prior Art

Various attempts have been made in the past to produce breathable, waterproof articles of apparel such as gloves and socks that will keep the wearer's hands and feet dry and at the same time permit perspiration to transpire through the article. Materials, which will accomplish this desired function, have been known for sometime. Among the most successful waterproof, breathable articles of apparel ever developed are those developed by the present inventor and described in U.S. Pat. Nos. 5,655,226, 5,483,703, and 5,402,540. Because of these patents to a complete understanding of the present inventions, U.S. Pat. Nos. 5,655,226, 5,483,703 and 5,402,540 are incorporated by reference as though fully set forth herein.

The present invention constitutes an improvement in the articles described in the aforementioned patents. More particularly, the articles of apparel of the present invention include a novel sealing cuff arrangement that guards against water entering the interior of the article at a location between the cuff and the covered extremity.

As will be better appreciated from the discussion which follows, the present invention provides, for the first time, articles of clothing such as socks and gloves which exhibit the comfort and stretchability of traditional types of sport socks and gloves that include a waterproof body portion and a novel, sealable cuff that provides an article that is both breathable and completely waterproof.

SUMMARY OF THE INVENTION

It is an object of the present invention to provide comfortable articles of apparel and the method of making the same which include a sealable cuff portion and a shaped body portion that will allow water vapor due to perspiration to transpire through the article but will prevent water from external sources from reaching the wearer's extremities.

A particular object of the invention is to provide a footwear article of the aforementioned character which includes an elastic sealing cuff that seals against the user's leg and prevents the entry of water between the cuff and the user's leg.

Another object of the invention is to provide articles of the aforementioned character in which water vapor from perspiration can be transmitted from the inside to outside of the body portion so that the natural evaporative cooling effect can be achieved.

Another object of the invention is to provide a method of making articles of the character described in the preceding paragraphs which is simple and straight forward, does not require the use of complicated equipment and can be performed by unskilled workmen with a minimum of training.

A particular object of the invention is to provide a sock as described in the preceding paragraphs which is of simple construction, is lightweight, is pliant and durable in use, and is easy to manufacture.

In its preferred form, the footwear article of the invention comprises a sock having a sealable cuff portion and an interconnected body portion. The body portion is of three-ply construction with the inside and outside plies being knit and the intermediate ply being made from an elastomeric polyurethane film. The three plies are uniquely bonded together using a pliant, waterproof adhesive. The sealable cuff portion is of a two-ply construction with the outside ply being an elastic knit and the inside ply being a continuation of the elastomeric polyurethane film of the body portion.

BRIEF DESCRIPTION OF THE DRAWINGS

FIG. 6 is a generally perspective view of one form of the footwear article of the invention shown covering the foot and lower leg portion of the user.

FIG. 7 is an enlarged, cross-sectional view taken along lines 7—7 of FIG. 6.

DESCRIPTION OF THE INVENTION

Figures 1, 2:
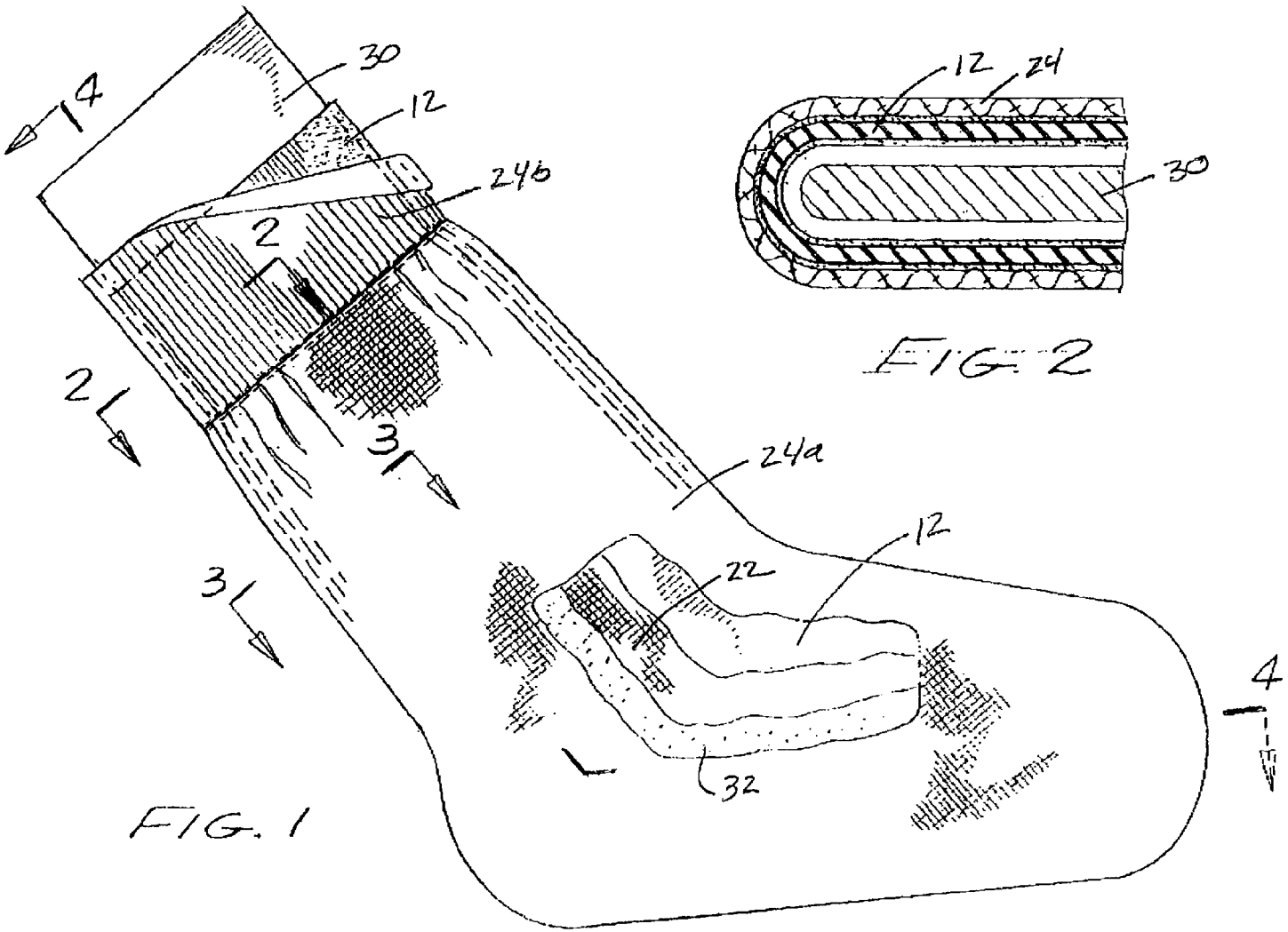
FIG. 1 is a side-elevational view illustrating the method of making the footwear article of the invention and showing the components of the article in position over a foot-shaped planar mandrel.
FIG. 2 is an enlarged, cross-sectional view taken along lines 2—2 of FIG. 1 showing the two-ply cuff construction.
Figure 3:
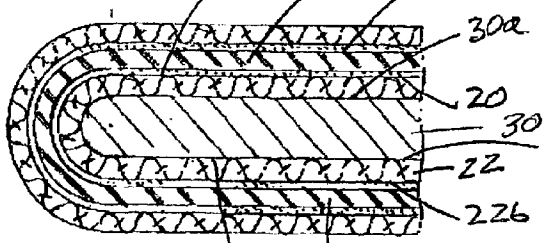
FIG. 3 is an enlarged, cross-sectional view taken along lines 3—3 of FIG. 1 showing the three-ply construction of the body portion.
Figure 4:
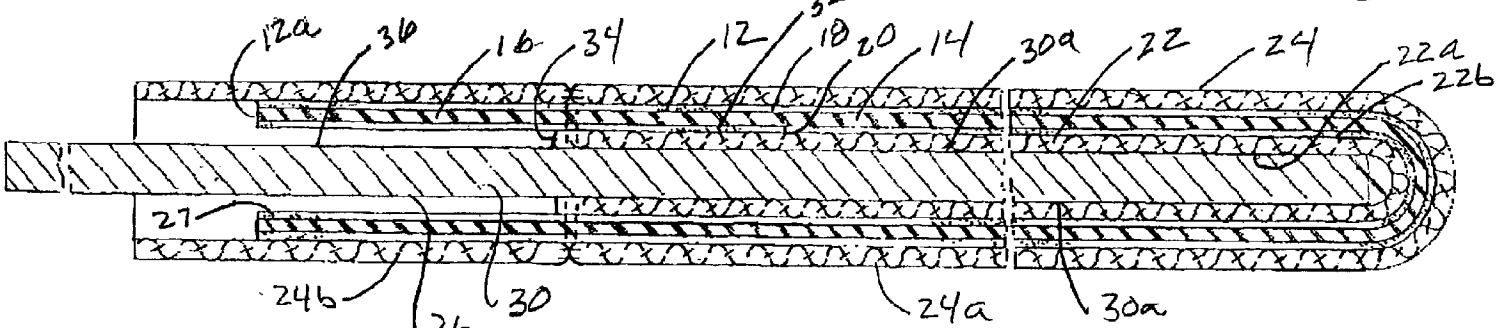
FIG. 4 is an enlarged, cross-sectional view taken along lines 4—4 of FIG. 1.

Referring to the drawings and particularly to FIGS. 1 through 4, one form of the article of apparel of the present invention is there shown. The article here comprises a sock construction including a thin, pliant bladder 12 constructed from a waterproof, breathable material, such as polyurethane sheet. The polyurethane sheet can be of various thicknesses as, for example, between about 1.0 mils and about 3.0 mils. Bladder 12 is of a first size and length and includes a lower body portion 14 and an upper cuff portion 16 (FIG. 4). Bladder 12 includes an outer surface 18 and an inner surface 20. Bladder 12 has the unique capability of generally conforming to the contours of the human foot and leg so that it can be comfortably worn inside a boot or shoe.

Bonded to the inner surface 20 of the elastomeric bladder is a lightweight covering member such as a first fabric inner sock 22 of standard construction, which is preferably made from knitted natural or synthetic fibers. Sock 22 is of a second size smaller than said first size and a second length less than the first length of bladder 12 (FIG. 4).

Figure 5:
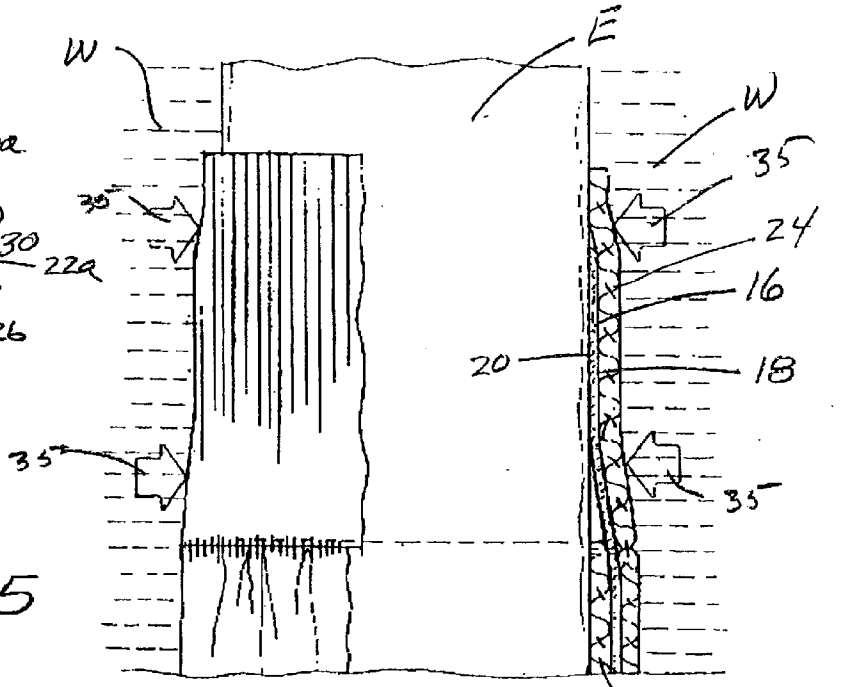
FIG. 5 is an enlarged, fragmentary, cross-sectional, illustrative view showing the manner in which the sealable cuff portion of the sock sealably engages the user's leg.

The article of the invention also includes a second fabric outer sock 24, the body portion 24*a* of which is bonded to the outer surface of the body portion 14 of bladder 12. Body portion 24*a* can be constructed from filament or spun yarns as well as from natural fibers such as wool fibers, or from a variety of synthetic fibers such as polyester or nylon and combinations thereof. Outer sock 24 also includes an upper cuff portion 24*b* that embodies elastic fibers that impart elasticity to the cuff portion causing it to be continuously urged inwardly toward the covered extremity. The techniques for weaving the stretch and return cuff portion 24*b* are well understood by those skilled in the art and several elastic fibers such as a fiber sold by duPont under the name and style "LYCRA" can be used in conjunction with other fibers to form the cuff portion. It is to be observed that second, or outer sock 24 is of a third size larger than the first size of bladder 12 and has a third length greater than the second length of inner sock 20 and also greater than the first length of bladder 12. More particularly, as best seen in FIGS. 4 and 5, the cuff portion of outer sock 24 preferably extends beyond the upper edge 12*a* of bladder 12 by a distance of about one-half inch.

Inner sock 22 and a portion of outer sock 24 are bonded to bladder 12 by means of a waterproof, heat activated adhesive. A hot melt adhesive in powder form sold by Bostik, Middleton, Mass., product #5116, a polyester type, has proven satisfactory for this purpose. Other adhesives can, of course, also be used, including a water-borne urethane heat activated, two-stage fluid adhesive sold by Stahl U.S.A. of Peabody, Massachusetts, under the designation UE-41742. In any event, the adhesive should be selected and applied in a manner that the breathability of the footwear is not destroyed or substantially reduced.

In the novel article of the present invention, the entire outer surface of the first sock 22 is securely bonded to bladder 12. However, as best seen in FIGS. 4 and 5, the cuff, or upper portion 16 of bladder 12, has its outer surface securely bonded to the upper elastic cuff portion 24*b* of an outer sock 24. In a manner presently to be described, elastic cuff 24*b* uniquely functions to urge the inner surface of the bladder into sealing engagement with the user's leg.

The thin, pliant, thermoplastic material from which the waterproof, breathable bladder is made is of a character that will prevent penetration of liquid water while at the same time permitting free passage of moisture vapor such as perspiration. This material can be a polyurethane sometimes described as thermoplastic urethane. A suitable material of this type is sold by Fabrite Laminating Corp. of Woodridge, N.J. Other suitable materials include elastomers made from polyesters, copolyesters, polyamides, cellulose derivatives, polyacrylic acid and its hologs, natural or synthetic rubber with hydrophilic impurities, copolyozamides, polyureas, polyelectrolytes, polyphosphates, polyvinylamid, polyvinylalcohol, polyether, and copolymers thereof, polythioether, polythioether-polyether, copolyepichlorohydrin-ether, polysulphosphates, copolyester-ether and derivatives or mixtures thereof.

Considering next the method of the invention, the thin, pliant bladder membrane is first coated with a light coating 27 of the hot melt adhesive to form a precursor, coated membrane. Next, the precursor, coated membrane is heated to a temperature slightly above the softening point of the adhesive, thereby causing the discrete particles of the adhesive which have been randomly deposited onto the bladder to fuse to the surface of the bladder material to form a coated membrane. Reference should be made to incorporated by reference U.S. Pat. No. 5,862,588 for a more detailed description of this adhesive deposition process.

The next step in one form of the method of the invention is the construction of the waterproof, breathable bladder. This is accomplished by overlaying two sheets of the previously described coated membrane and then to define on the membrane a line circumscribing the boundary of the bladder. This done, the sheets of coated membrane are heated along the boundary line to a temperature sufficient to sealably bond the membranes together along the boundary line. This heating-fusion step can be accomplished in several ways well known to those skilled in the art, including the techniques described in the incorporated by reference U.S. Pat. Nos. 5,655,226, 5,483,703 and 4,942,214. The heating-fusion step produces a bladder having a perimeter of a first size and length. As indicated in FIGS. 1 and 5, the bladder 12 has an extremity-receiving portion that is in the general shape of the wearer's extremity.

As illustrated in FIGS. 1 and 4 of the drawings, the next step in the method of the invention is to place the first covering member, or inner sock 22 over a generally foot-shaped, approximately ⅛th inch thick, generally planar mandrel 30 having smooth outer surfaces. Sock 22, which has inner and outer surfaces 22*a* and 22*b* (FIG. 3) is placed over the mandrel so that inner surface 22*a* thereof is disposed in engagement with the faces 30*a* of mandrel 30. As previously discussed, sock 22 can be constructed from a variety of materials and has a perimeter of a second size smaller than the size of the bladder and a second length less than the length of the bladder 12. For cold weather comfort, the inner sock can be made utilizing THERMAX® material made by E. I duPont de Nemours and Co. of Wilmington, Del. For warm weather comfort the inner sock can be made utilizing a COOLMAX® material made by duPont.

After sock 22 has been placed over mandrel 30 and smoothed out so that its inner surface 22*a* is in close engagement with the faces of the mandrel 30, a light coating 32 of adhesive is applied to the exposed surface 22*b* of sock 22 (FIG. 3). The adhesive can be applied to sock 22 by spraying, rolling, painting or in any other customary way. This done, a first assemblage is formed by carefully placing bladder 12 over the assemblage of sock 22 and mandrel 30 and is smoothed so that the inner surface of the bladder is in close engagement with the adhesive coated sock 22. This first assemblage has a third size and shape as illustrated in the drawings.

Either before or after emplacement of the bladder onto the mandrel, a second covering member or sock 24 is emplaced over another mandrel and appropriately smoothed out. Second sock 24 has a perimeter of a fourth size larger than the size of the first assemblage and a third length greater than the second length of first sock 22. The exposed, or second surface of sock 24, is then coated with a layer 34 of adhesive and the adhesive is allowed to dry. The second sock is then removed from the mandrel, turned inside out and placed over bladder 12 which is mounted on the first mandrel 30 over first sock 22. With this arrangement, the adhesive coated, second side of sock 24 is in engagement with the exposed surface 18 of bladder 12 and the second, or precursor, assemblage thus formed has the configuration shown in FIG. 4. As can be seen in FIG. 4, the lower body portion of the precursor assemblage is three-ply while the upper cuff portion 24*b* is only two ply with bladder 12 extending a substantial distance above the upper margin 34 of inner sock 22.

The precursor assembly comprising the bonded together first adhesive coated sock 22, the bladder 12 and the second adhesive coated sock 24 is then heated and compressed in the manner described in the incorporated by reference U.S. Pat. Nos. 5,655,226; 5,483,703 and 4,942,214 to form the finished article. Briefly, this step is accomplished by placing the mandrel, upon which the precursor assembly is mounted, between two platens that can be controllably heated and urged together. During this temperature-pressure step, the polymer of the adhesive is cross linked making a permanent, waterproof bond of inner sock 22 to outside of the bladder and the outer sock 24 to the other side of the bladder.

Additionally, due to the unique design of the article of apparel of the invention, during the temperature, pressure step, portion 16 of bladder 12, that is the portion of the bladder extending above margin 34 of inner sock 22, is urged against the smooth surfaces 36 of mandrel 30 (FIG. 4). As the adhesive 27, which was previously deposited on bladder 12, melts and is pressed against the mandrel, it will melt to form a smooth surface that exhibits exceptional sealing capabilities.

After completion of the heating and compression step, the precursor assembly is removed from the press and allowed to cool thoroughly prior to doffing the completed waterproof footwear article from the mandrel. When removed from the mandrel, the footwear article is generally planar in shape and in one form of the invention, the article may be stitched along the margin of the bladder and the cuff. In use, when the foot is inserted into the open cuff of the article, the foot engaging portion of the sock will neatly and smoothly conform to the shape of the wearer's foot.

Similarly, when the sock is in use, the elastic cuff portion 24*b* of the outer sock 24 exerts inward forces against the user's extremities as indicated by the arrows 35 in FIG. 5. These forces cause the glaze-like surface formed on the bladder to sealably press against the skin of the user forming a substantially water tight seal. As indicated in FIG. 5, even when the user's extremity "E" is submersed in water "W", this seal will prevent water from passing between the upper bladder portion 16 and the user's skin.

Turning to FIGS. 6 and 7, a slightly different sock construction of the invention is shown in position over a user's foot and lower leg. This sock construction is substantially similar to that shown in FIGS. 1 through 5 of the drawings and like numbers are used to identify like components. As before, the sock construction comprises a thin, pliant bladder 12 constructed from a waterproof, breathable material, such as polyurethane sheet (FIG. 7). Bladder 12 includes a lower body portion 14 and an upper cuff portion 16 and has an outer surface 18 and an inner surface 20. As earlier pointed out, bladder 12 has the unique capability of generally conforming to the contours of the human foot and leg so that it can be comfortably worn inside a boot or shoe.

Bonded to the inner surface 20 of the elastomeric bladder is a lightweight covering member such as a first fabric inner sock 22 of standard construction, which is preferably made from knitted natural or synthetic fibers (FIG. 7). Sock 22 is of a second size smaller than said first size and a second length less than the first length of bladder 12.

The article of the invention also includes a second fabric outer sock 40, the body portion 40*a* of which is bonded to the outer surface of the body portion 14 of bladder 12 in the manner previously described. Outer sock 40 also includes an upper cuff portion 40*b* that embodies elastic fibers that impart elasticity to the cuff portion causing it to be continuously urged inwardly toward the covered extremity in the manner indicated by the arrow 42 of FIG. 7. As in the earlier described embodiments outer sock 40 is of a third size larger than the first size of bladder 12 and has a third length greater than the second length of inner sock 20 and also greater than the first length of bladder 12. Also shown in FIG. 1, the cuff portion of outer sock 40 uniquely comprises a first or lower section 44 that is in overlaying engagement with bladder 12 and a second upper section 46 that extends beyond the upper edge 12*a* of bladder 12.

As before, the entire outer surface of the first sock 22 is securely bonded to bladder 12. However, as best seen in FIG. 7, the cuff, or upper portion 16 of bladder 12, has its outer surface securely bonded to the elastic cuff portion 44 of an outer sock 40. With this construction, elastic cuff 44 uniquely functions to urge the inner surface of the bladder into sealing engagement with the user's leg "L" in the manner illustrated in FIG. 7 (see also FIGS. 1 and 5).

Figures 8, 9:
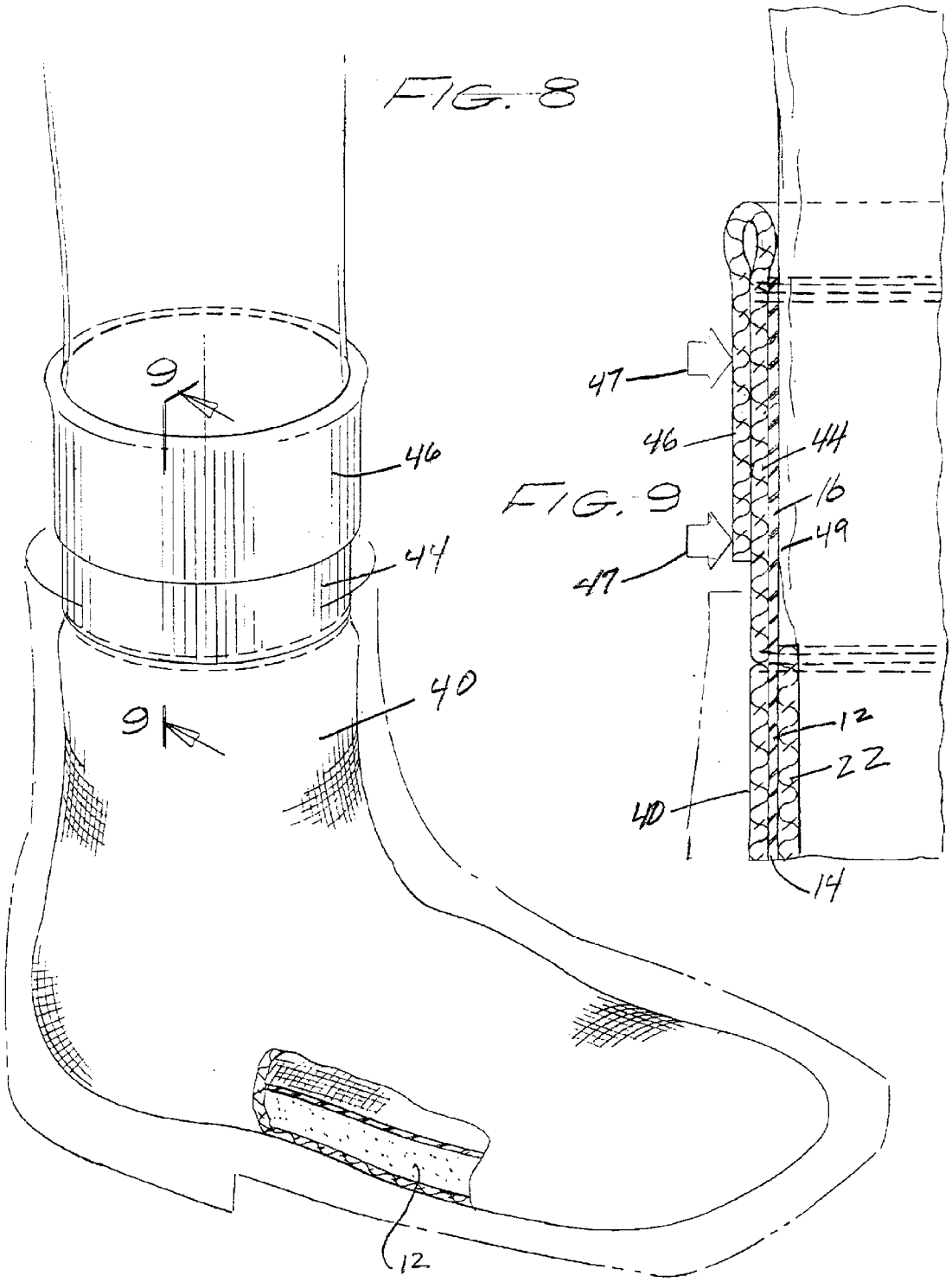
FIG. 8 is a generally perspective view similar to FIG. 6 but showing the cuff portion of the footwear article folded down.
FIG. 9 is an enlarged, cross-sectional view taken along lines 9—9 of FIG. 8.

If desired, the portion of the elastic cuff that extends beyond upper edge 12*a* of the bladder can be folded down in the manner shown in FIGS. 8 and 9. When so folded down, additional forces are exerted on the bladder in the direction of the arrows 47 of FIG. 9 that tend to urge the bladder into sealing engagement with the user's leg "L". When the sock is in use, these inward forces cause the glaze-like surface 49 formed on the bladder portion 44 to sealably press against the skin of the user forming a substantially watertight seal. As previously mentioned, even when the user's foot and lower leg is submersed in water, this novel seal action will prevent water from passing between bladder portion 44 and the user's skin.

Having now described the invention in detail in accordance with the requirements of the patent statutes, those skilled in this art will have no difficulty making changes and modifications in the individual parts or their relative assembly in order to meet specific requirements or conditions. Such changes and modifications may be made without departing from the scope and spirit of the invention, as set forth in the following claims.

I claim:

1. An article of apparel used to cover a wearer's extremities comprising:

(a) an adhesive coated bladder having a perimeter of a first size and a first length and having an extremity receiving portion in the general shape of the wearer's extremity to be covered, said adhesive coated bladder having an upper portion having a smooth, glazed extremity engaging portion for sealably engaging a portion of the wearer's extremities and a lower portion, each said upper and lower portion having a smooth outer surface and a smooth inner surface generally conformable to the contours of the extremity to be covered said upper portion of said bladder being so constructed and arranged to engage the extremity to be covered;

(b) a first fabric member connected to said inner surface of said adhesive coated bladder, said first fabric member having a perimeter of a second size smaller than said first size and a second length less than said first length and being in the general shape of the wearer's extremity; and (c) a second fabric member connected to said outer surface of said adhesive coated bladder, said second fabric member having a length greater than said second length of said first fabric member, and a length greater than said first length of said bladder, said second fabric member including a lower portion and an upper, elastic cuff for urging said smooth, glazed extremity engaging portion of said bladder into sealing engagement with a portion of the wearer's extremity, said elastic cuff having a first section and a second section disposed in overlaying engagement with said smooth, glazed extremity engaging portion of said bladder.

2. The article as defined in claim 1 in which said adhesive coated bladder comprises a thin, generally planar, smooth surfaced thin film having a wall thickness of between about 0.001 and 0.003 inches.

3. The article of apparel as defined in claim 1 in which said article comprises a sock.

4. The article of the apparel as defined in claim 1 in which said bladder has an upper extremity and in which said first section of said elastic cuff extends beyond said upper extremity of said bladder.

5. An article of apparel used to cover a wearer's foot and lower leg comprising:

(a) an adhesive coated bladder comprising a continuous wall having an inner and an outer surface and including a foot receiving portion in the general shape of the wearer's foot and lower leg engaging portion constructed and arranged to circumscribe and closely engage the wearer's lower leg;

(b) a first fabric member connected to said inner surface of said adhesive coated bladder; and (c) a second fabric member connected to said outer surface of said adhesive coated bladder, said second fabric member having an elastic cuff for urging said inner surface of said lower leg engaging portion of said adhesive coated bladder into sealable contact with the wearer's lower leg.

6. The article as defined in claim 5 in which said lower leg engaging portion of said adhesive coated bladder includes a smooth, glazed inner surface conformable to the shape of the user's lower leg.

7. The article as defined in claim 6 in which said adhesive coated bladder comprises a thin, generally planar, smooth surface thin film having a wall thickness of between about 0.001 and 0.003 inches.

8. The article as defined in claim 7 in which said foot receiving portion of said adhesive coated bladder and said leg engaging portion thereof are integrally formed.

9. A method of making an article of apparel used to cover a wearer's extremities comprising the steps of:

(a) depositing a heat activated adhesive on the surface of a stretchable, waterproof, breathable membrane to form a coated membrane;

(b) forming said coated membrane into a bladder having an extremity receiving portion in the general shape of the wearer's extremity to be covered, said bladder having an upper portion and a lower portion, each said upper and lower portion having an outer surface and an inner surface generally conformable to the contours of the extremity covered;

(c) placing a first fabric member over a mandrel having a smooth surface;

(d) placing said bladder over said first fabric member to form a first assemblage, said first assemblage comprising said bladder, said first fabric member and said mandrel, said bladder overlaying said lower portion of said first fabric member with said upper portion of said bladder extending beyond said fabric member;

(e) placing a second fabric member over said first assemblage to form a second assemblage, said second fabric member having a lower portion and an upper elastic cuff, said elastic cuff overlaying said upper portion of said bladder, (f) simultaneously heating and compressing said second assemblage at a temperature and pressure sufficient to form a composite in which said fabric members are securely bonded to said lower portion of said bladder and in which said upper portion of said bladder is securely bonded to said elastic cuff, said upper portion of said bladder being compressed against said smooth surface of said mandrel to form a smooth, glazed extremity engaging portion for engagement with the wearer's extremity; and (g) removing said composite from said mandrel.

10. A method of making an article of apparel used to cover a wearer's foot and lower leg comprising the steps of:

(a) depositing a heat activated adhesive on the surface of a stretchable, waterproof, breathable membrane to form a coated membrane;

(b) forming said coated membrane into a bladder having a perimeter of a first size and a first length and having an extremity receiving portion in the general shape of the wearer's extremity to be covered, said bladder having an upper portion and a lower portion, each said upper and lower portion having an outer surface and an inner surface generally conformable to the contours of the extremity to be covered;

(c) placing a first fabric member over a mandrel having a smooth surface, said first fabric member having a perimeter of a second size smaller than said first size and a second length less than said first length and being in the general shape of the wearer's extremity;

(d) placing said bladder over said first fabric member to form a first assemblage having a third size, said first assemblage comprising said bladder, said mandrel and said first fabric member, a portion of said bladder overlaying said first fabric member and a portion of said bladder extending beyond said first fabric member;

(e) placing a second fabric member over said first assemblage to form a second assemblage, said second fabric member having a third length greater than said second length of said first fabric member and including a lower portion and an upper, elastic cuff, said elastic cuff being disposed in overlaying engagement with said portion of said bladder extending beyond said first fabric member;

(f) simultaneously heating and compressing said second assemblage at a temperature and pressure sufficient to form a composite in which said first and second fabric members are securely bonded to said bladder and in which said upper portion of said bladder is securely bonded to said lower section of said elastic cuff of said second fabric member, said upper portion of said bladder being urged into engagement with said smooth surface of said mandrel to form a smooth, glazed extremity engaging portion for engagement with the wearer's lower leg; and (g) removing said composite from said mandrel.

11. A method as defined in claim 10 in which said waterproof, breathable membrane comprises a thin, generally planar, smooth surface thin film having a wall thickness of about 0.0016 inch.

* * * * *